US009697969B2

(12) United States Patent
Kang et al.

(10) Patent No.: US 9,697,969 B2
(45) Date of Patent: Jul. 4, 2017

(54) FUSE RESISTOR

(71) Applicant: SMART ELECTRONICS INC., Ulsan (KR)

(72) Inventors: Doo Won Kang, Anyang-si (KR); Hyun Chang Kim, Ulsan (KR); Hwang Je Mun, Busan (KR); A Lam Shin, Yangsan-si (KR)

(73) Assignee: Smart Electronics Inc., Ulsan (KR)

( * ) Notice: Subject to any disclaimer, the term of this patent is extended or adjusted under 35 U.S.C. 154(b) by 112 days.

(21) Appl. No.: 14/656,065

(22) Filed: Mar. 12, 2015

(65) Prior Publication Data

US 2015/0262775 A1 Sep. 17, 2015

(30) Foreign Application Priority Data

Mar. 17, 2014 (KR) ..... 10-2014-0030751

(51) Int. Cl.

| | |
|---|---|
| ***H01H 37/04*** | (2006.01) |
| ***H01H 37/32*** | (2006.01) |
| ***H01C 7/13*** | (2006.01) |
| ***H01H 37/76*** | (2006.01) |
| *H01H 85/041* | (2006.01) |

(52) U.S. Cl.

CPC ..... *H01H 37/04* (2013.01); *H01C 7/13* (2013.01); *H01H 37/761* (2013.01); *H01H 85/0418* (2013.01); *H01H 2037/046* (2013.01)

(58) Field of Classification Search

CPC ..... H01H 37/04; H01H 37/761; H01H 2037/046; H01H 85/0418; H01C 7/13

USPC ..... 337/153, 182, 183

See application file for complete search history.

(56) References Cited

U.S. PATENT DOCUMENTS

| | | | | |
|---|---|---|---|---|
| 3,265,839 A * | 8/1966 | Johnson | ..... | F25B 13/00 337/103 |
| 3,735,318 A * | 5/1973 | Bucklin | ..... | H01H 85/046 337/160 |
| 3,786,388 A * | 1/1974 | Sato | ..... | H01R 13/68 337/198 |
| 3,931,602 A * | 1/1976 | Plasko | ..... | H01H 85/044 337/163 |

(Continued)

FOREIGN PATENT DOCUMENTS

| | | |
|---|---|---|
| JP | 07-220597 A | 8/1995 |
| JP | 63-185002 A | 7/1998 |

(Continued)

OTHER PUBLICATIONS

JP 2008-97943, Apr. 24, 2008, English Machine Translation.*

*Primary Examiner* — Anatoly Vortman

(74) *Attorney, Agent, or Firm* — Novick, Kim & Lee, PLLC; Jae Youn Kim

(57) ABSTRACT

Disclosed is a fuse resistor provided on an electrical circuit to protect the electrical circuit and elements. The fuse resistor includes a substrate on which first and second resistive terminals and fuse terminals are formed, first and second resistive elements surface-mounted on the first and second resistive terminals and dividing applied current or voltage, and a temperature fuse surface-mounted on the fuse terminals and broken by heat generated from the first and second resistive elements. If overcurrent or overvoltage is applied, the first and second resistive elements generate heat and the temperature fuse is broken by the generated heat.

14 Claims, 16 Drawing Sheets

(56) References Cited

U.S. PATENT DOCUMENTS 4,654,619 A * 3/1987 Guichard ..... H01T 4/06 337/31
5,621,602 A * 4/1997 Winkelmann ..... H01H 85/048 337/184
5,712,610 A * 1/1998 Takeichi ..... H01H 85/046 29/623
6,452,475 B1 * 9/2002 Kawazu ..... H01H 85/463 29/623
6,566,995 B2 * 5/2003 Furuuchi ..... H01L 23/5256 257/E23.149
7,286,037 B2 * 10/2007 Furuuchi ..... H01H 85/046 337/159
7,920,044 B2 * 4/2011 Scheiber ..... D06F 58/26 337/186
8,174,351 B2 * 5/2012 Scheiber ..... D06F 8/26 337/112
8,400,252 B2 * 3/2013 Jung ..... H01H 85/0052 337/182
8,400,253 B2 * 3/2013 Jung ..... H01H 69/02 337/182
2002/0014945 A1 * 2/2002 Furuuchi ..... H01L 23/5256 337/158
2004/0087191 A1 * 5/2004 Hung ..... H05K 1/181 439/70
2015/0303011 A1 * 10/2015 Jung ..... H02H 7/18 337/414
2015/0303012 A1 * 10/2015 Jung ..... H02H 7/18 337/414

FOREIGN PATENT DOCUMENTS

JP 2000323308 A * 11/2000
JP 2006024675 A * 1/2006
JP 2008-97943 A 4/2008
KR 1991-0000806 Y1 2/1991
KR 10-0560058 B1 3/2006
TW 1265539 B 11/2006
TW 2009-45377 A 11/2009
TW 2011-01362 A 1/2011

* cited by examiner

FUSE RESISTOR

BACKGROUND OF THE INVENTION

Field of the Invention

The present invention relates to a fuse resistor, and more particularly to a fuse resistor in which functions of a fuse and a resistor may be performed together, resistive elements and a temperature fuse are installed on a substrate in a surface mount type and thus automation may be facilitated, the plural resistive elements are properly disposed and thus the functions of the fuse and the resistor may be effectively performed, and a manufacturing method thereof.

Description of the Related Art

In general, in an electrical circuit of a large electronic product, such as an LCD TV or a PDP TV, or a portable electronic apparatus, such as a smartphone or a tablet PC, a protective device, such as a thermal fuse resistor, to prevent malfunction of the apparatus caused by inrush current, internal temperature rise or continuous supply of overcurrent, generated while powered on or a battery is being charged, is provided at a power input terminal of the electrical circuit so as to protect a power circuit.

Such a fuse resistor includes a resistive body and a temperature fuse and the resistive body and the temperature fuse are connected in series by lead wires.

Further, in the fuse resistor, the resistive body and the temperature fuse are packaged with a case so that other electronic parts are not damaged by scraps generated when a fuse element is broken, and the inside of the case is filled with a filler.

Here, the filler is a slurry type filler including silicon oxide ($SiO_2$) in consideration of heat resistance, conductance, and a thermosetting property, and the case is generally formed of ceramic like that of conventional resistors.

The end of the lead wire is extended to be withdrawn from the case, and the conventional fuse resistor is installed on a printed circuit board by soldering the ends of the lead wires to the printed circuit board so that the resistive body and the temperature fuse are installed erectly.

Therefore, if inrush current is introduced into the above fuse resistor, the fuse resistor restricts the inrush current to designated current using the resistive body and, if overcurrent is introduced into the fuse resistor, the fuse resistor conducts heat generated from the resistive body to the temperature fuse through the filler and shorts the circuit so that the fuse element formed of lead in a solid state or high polymer pellets may be broken, thus protecting the electrical circuit of an electric home appliance.

With reference to FIG. 10, Korean Registered Patent NO. 10-1060013 discloses a temperature fuse resistor including a resistive body, a temperature fuse provided to short a circuit by exothermic reaction of the resistive body, a lead wire connecting the resistive body and the temperature fuse in series, a case, one surface is opened so as to receive the resistive body and the temperature fuse under the condition that the end of the lead wire is withdrawn from the case, provided with a withdrawal groove on one side wall of the case so as to withdraw the lead wire, and a filler filling the inside of the case so that the resistive body and the temperature fuse are inserted into the filler and including silicon oxide, wherein the case is formed by injection molding using a thermosetting resin having lower heat resistance than the filler.

However, in case of the temperature fuse resistor of the above Korean Registered Patent, the resistive body is provided at only one side of the temperature fuse and thus, heat generated if rated current is applied is not dispersed and a product temperature in a normal state is raised.

Further, in the temperature fuse resistor of the above Korean Registered Patent, a lead wire connecting the resistive body and the temperature fuse and lead wires extended to the outside of the case are required and thus, manufacture of such a temperature fuse resistor is difficult to automate.

SUMMARY OF THE INVENTION

Therefore, the present invention has been made in view of the above problems, and it is an object of the present invention to provide a fuse resistor in which resistive elements and a temperature fuse are directly surface-mounted on a substrate and thus automation may be facilitated and lead wires connecting the resistive elements and the temperature fuse are omitted and thus a manufacturing process may be simplified.

It is another object of the present invention to provide a fuse resistor in which, if inrush current is applied, the inrush current is restricted to designated current by resistive elements and thus a circuit or a product may be protected.

It is another object of the present invention to provide a fuse resistor in which, if surge voltage is applied to the inside of a circuit, the surge voltage is absorbed by resistive elements and thus a circuit or a product may be protected.

It is another object of the present invention to provide a fuse resistor in which, if parts within a circuit are damaged or shorted, a coil of a resistive element is opened to protect the circuit, and more particularly, resistance of a first resistive element is reduced as compared to a second resistive element by reducing the coil diameter and the coil turn number of the first resistive element and thus explosive power may be reduced in case of a short.

It is yet another object of the present invention to provide a fuse resistor in which first and second resistive elements disposed at both sides of a temperature fuse generate heat when overvoltage or overcurrent is applied and thus breaking time of the temperature fuse may be shortened.

According to an aspect of the present invention, there is provided a fuse resistor provided on an electrical circuit to protect the electrical circuit and elements, the fuse resistor comprising: a substrate on which first and second resistive terminals and fuse terminals are formed; first and second resistive elements surface-mounted on the first and second resistive terminals and dividing applied current or voltage; and a temperature fuse surface-mounted on the fuse terminals to be broken by heat generated from the first and second resistive elements, wherein, the first and second resistive elements are installed at both sides of the temperature fuse, if overcurrent or overvoltage is applied, the first and second resistive elements generate heat and the temperature fuse is broken by the generated heat.

In the fuse resistor, each of the first and second resistive elements is a wound type resistive element including a resistive body, resistive caps provided at both ends of the resistive body, and a coil wound on the outer circumferential surface of the resistive body.

In the fuse resistor, the first and second resistive elements have the same resistance value and the coils of the first and second resistive elements have the same diameter.

In the fuse resistor, the first and second resistive elements have different resistance values and the coils of the first and second resistive elements have different diameters.

In the fuse resistor, the resistive body of the first resistive element is smaller than the resistive body of the second resistive element; the coil of the first resistive element has a smaller turn number than the coil of the second resistive element; and if the electrical circuit or the elements mounted on the electrical circuit are abnormally operated, at least the coil of the first resistive element is opened.

In the fuse resistor, the first resistive element has a smaller resistance value than the second resistive element and the coil of the first resistive element has a smaller diameter than the coil of the second resistive element; and if the electrical circuit or the elements mounted on the electrical circuit are abnormally operated, at least the coil of the first resistive element is opened.

In the fuse resistor, if a short occurs in the electrical circuit or if the elements mounted on the electrical circuit are damaged and aged, at least the coil of the first resistive element is opened.

In the fuse resistor, the first and second resistive elements are installed at both sides of the temperature fuse.

In the fuse resistor, lead wire terminals are formed on the substrate; and surface mount type lead wires are mounted on the lead wire terminals.

In the fuse resistor, the substrate is provided with a pad which is combined with a main substrate using solder ball.

According to the fuse resistor of the present invention as described above, it is possible to provide a fuse resistor in which resistive elements and a temperature fuse are directly surface-mounted on a substrate and thus automation may be facilitated and lead wires connecting the resistive elements and the temperature fuse are omitted and thus a manufacturing process may be simplified.

Also, it is possible to provide a fuse resistor in which, if inrush current is applied, the inrush current is restricted to designated current by resistive elements and thus a circuit or a product may be protected.

Also, it is possible to provide a fuse resistor in which, if surge voltage is applied to the inside of a circuit, the surge voltage is absorbed by resistive elements and thus a circuit or a product may be protected.

Also, it is possible to provide a fuse resistor in which, if parts within a circuit are damaged or shorted, a coil of a resistive element is opened to protect the circuit, and more particularly, resistance of a first resistive element is reduced as compared to a second resistive element by reducing the coil diameter and the coil turn number of the first resistive element and thus explosive power may be reduced in case of a short.

Also, it is possible to provide a fuse resistor in which first and second resistive elements disposed at both sides of a temperature fuse generate heat when overvoltage or overcurrent is applied and thus breaking time of the temperature fuse may be shortened.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, preferred embodiments of the present invention will be described in detail with reference to the annexed drawings.

Figure 1:
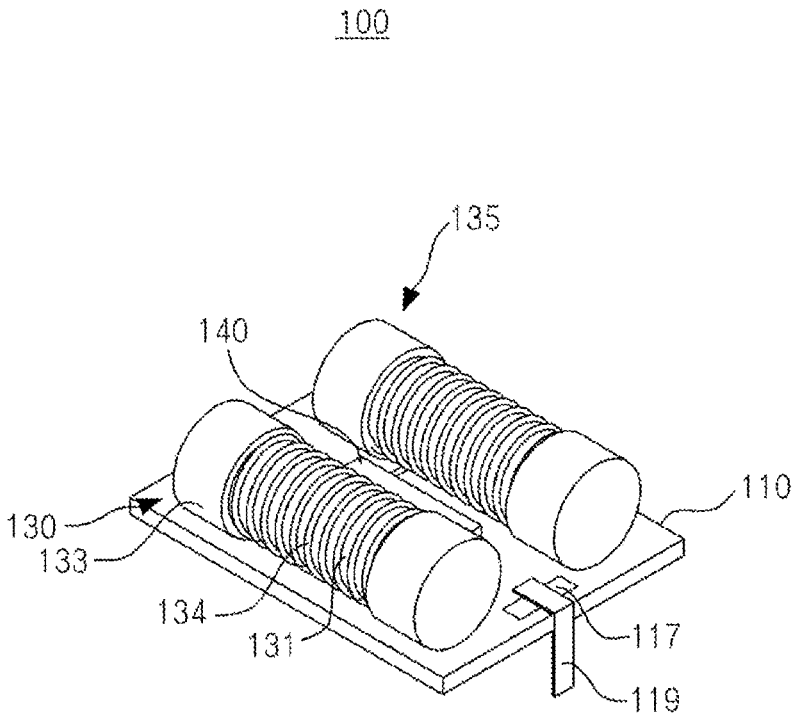
FIG. 1 is a perspective view illustrating a fuse resistor in accordance with one embodiment of the present invention.
Figure 2:
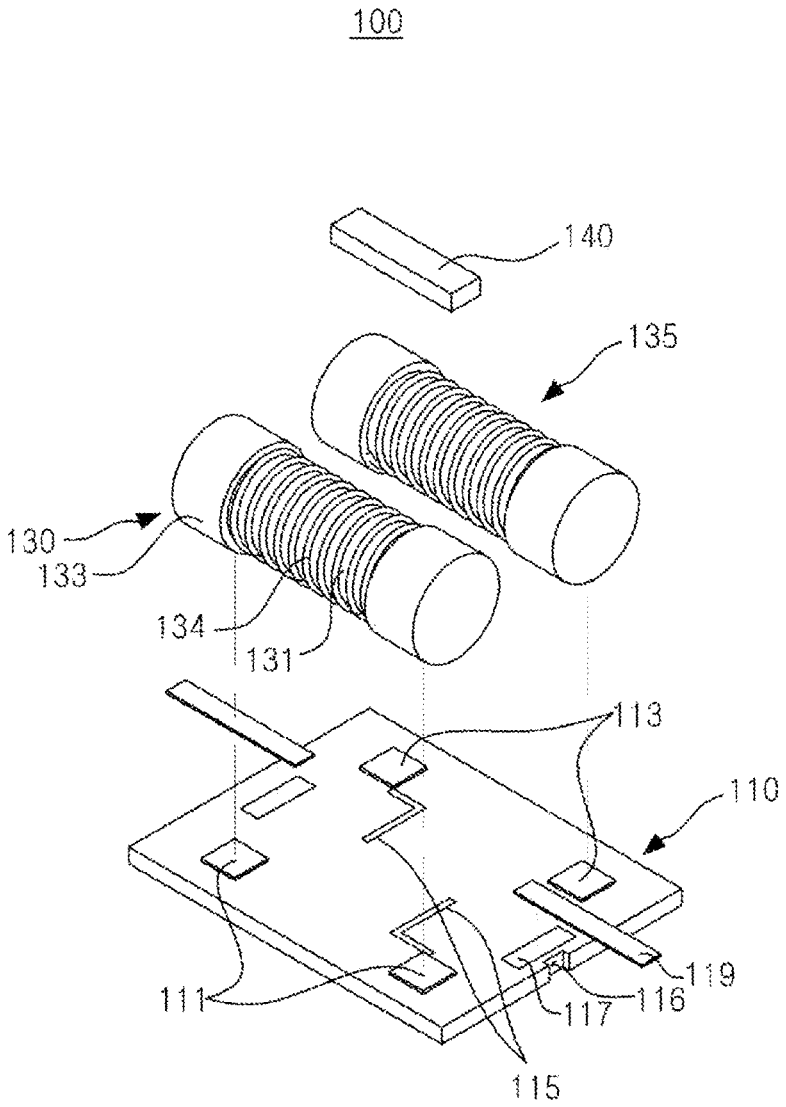
FIG. 2 is an exploded perspective view illustrating the fuse resistor in accordance with the embodiment of the present invention.

With reference to FIGS. 1 and 2, a fuse resistor 100 in accordance with the present invention is designed for use in an electrical circuit of an electronic product, and may generally include a substrate 110, first and second resistive elements 130 and 135, and a temperature fuse 140.

First and second resistive terminals 111 and 113, fuse terminals 115, lead wire terminals 117, and slots 116 are formed on the substrate 110.

Each of the first and second resistive elements 130 and 135 may be a wound type resistive element including a resistive body 131 having a rod shape, resistive caps 133 provided at both ends of the resistive body 131, and a coil 134 wound on the outer circumferential surface of the resistive body 131.

Further, each of the first and second resistive elements 130 and 135 may be an SMD type resistive element without a lead wire so as to be surface-mounted on the first resistive terminals 111 or the second resistive terminals 113. Here, the resistive caps 113 may be fixed to the resistive terminals 111 and 113 of the substrate 110 using a solder paste (not shown).

The temperature fuse 140 is surface-mounted on the fuse terminals 115. When overvoltage or overcurrent is applied and the first and second resistive elements 130 and 135 generate heat, the temperature fuse 140 is broken by the generated heat and thus, serves to intercept electrical connection.

The temperature fuse 140 may be a fuse element of a bar shape including a low melting point metal or alloy having a low melting point of less than 450° C., for example, including at least one of Sn, Ag, Sb, In, Bi, Al, Zn, Cu, and Ni.

Figure 3:
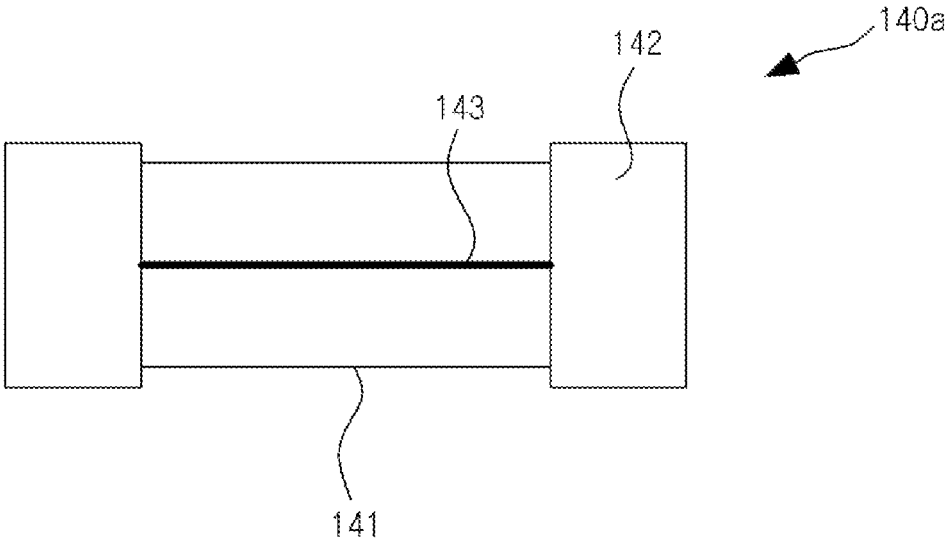
FIG. 3 is a view illustrating a temperature fuse having a structure differing from a temperature fuse of FIG. 2.

For example, as exemplarily shown in FIG. 3, a temperature fuse 140*a* may include a ceramic tube pipe 141, terminals 142 formed at both ends of the ceramic tube pipe 141, and a fuse wire 143 inserted into the ceramic tube pipe 141.

Figure 4A:
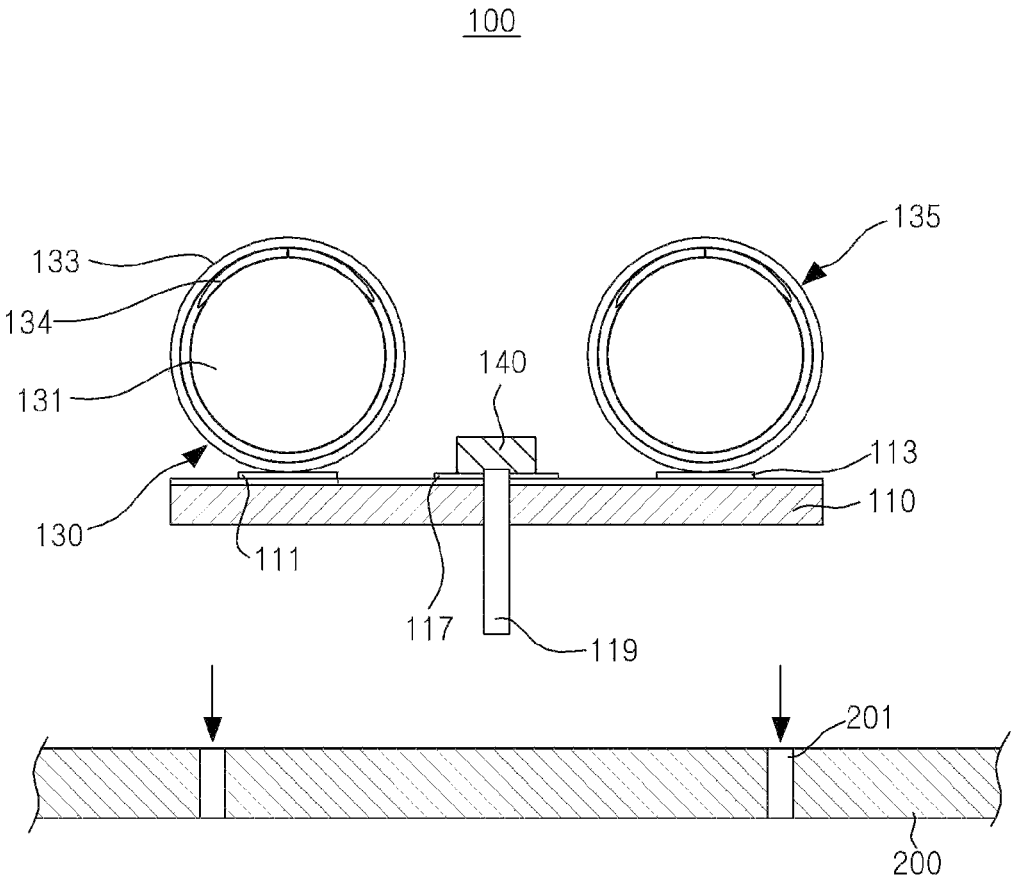
FIGS. 4A to 4C are views illustrating mounting methods of the fuse resistor in accordance with the present invention on a main substrate.

With reference to FIGS. 1, 2, and 4A, the lead wire terminals 117 formed on the substrate 110 are electrically connected to the first and second resistive terminals 111 and 113 through a circuit pattern (not shown), and surface mount type lead wires 119 having a plate shape are surface-mounted on the lead wire terminals 117.

Further, the surface-mounted lead wires 119 are bent downwardly, fitted into the slots 116, inserted into holes 201 formed on a main substrate 200, and then soldered.

Figure 4B:
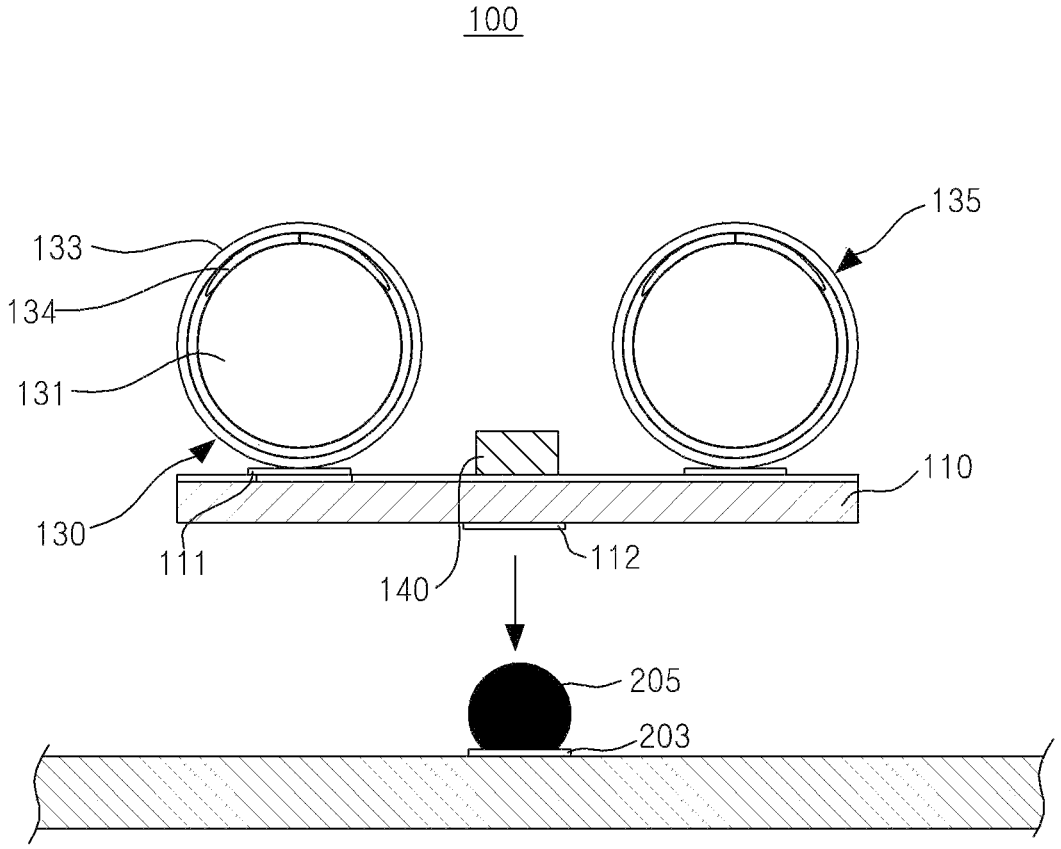

With reference to FIG. 4B, the fuse resistor 100 in accordance with the present invention may be surface-mounted on the main substrate 200. In more detail, a pad 112 is formed on the substrate 110, and a fuse resistor terminal 203 is formed on the main substrate 200. A solder ball 205 is formed on the fuse resistor terminal 203, and the substrate 110 is connected to the main substrate 200 by mounting the pad 112 on the solder ball 205.

Figure 4C:
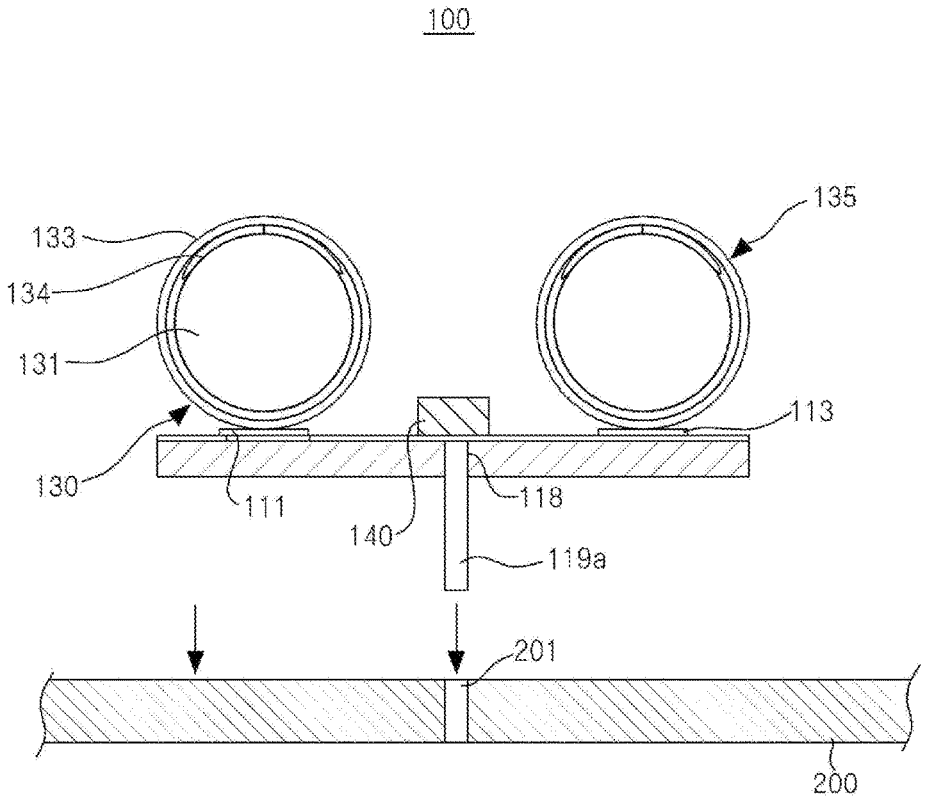

With reference to FIG. 4C, a lead wire terminal 118 may be vertically formed through the substrate 110. The lead wire terminal 118 is electrically connected to the first and second resistive terminals 111 and 113 through a circuit pattern (not shown), and a lead wire 119*a* is soldered under the condition that the lead wire 119*a* is inserted into the lead wire terminal 118.

Figure 5A:
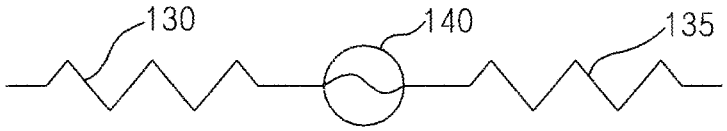
FIGS. 5A and 5B are circuit diagrams illustrating first and second resistive elements in accordance with the present invention, respectively arranged in series and in parallel.
Figure 5B:
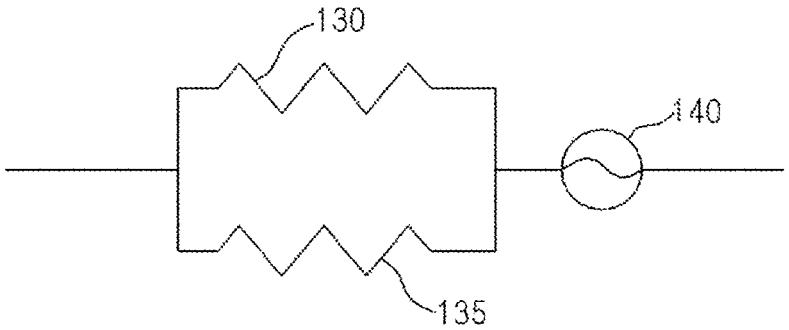

FIGS. 5A and 5B are circuit diagrams illustrating the first and second resistive elements in accordance with the present invention, which are respectively arranged in series and in parallel.

The first and second resistive elements 130 and 135 in accordance with the present invention may be connected in series or in parallel.

With reference to FIG. 5A, in accordance with the present invention, the first resistive element 130, the temperature fuse 140 and the second resistive element 135 may be sequentially connected in series, or the first resistive element 130, the second resistive element 135 and the temperature fuse 140 may be sequentially connected in series.

If the first and second resistive elements 130 and 136 are connected in series as such, voltage applied to the fuse resistor 100 is divided and thus, impact due to surge voltage may be reduced.

Further, with reference to FIG. 5B, the first resistive element 130 and the second resistive element 135 may be connected in parallel and then, the temperature fuse 150 may be connected thereto in series.

If the first and second resistive elements 130 and 136 are connected in parallel as such, current applied to the fuse resistor 100 is divided and thus, impact due to inrush current or surge current may be reduced.

However, hereinafter, a configuration in which the first resistive element 130, the temperature fuse 140, and the second resistive element 135 are sequentially connected in series will be described.

Hereinafter, the fuse resistor in accordance with the present invention ① if overcurrent/overvoltage is applied, ② if inrush current is applied, ③ if surge voltage exceeding a designated voltage value is applied, and ④ if the electrical circuit and the elements are abnormally operated, will be individually described.

First, the fuse resistor 100 in accordance with the present invention may prevent generation of an unnecessarily excessive amount of heat in a normal state.

That is, in case of a conventional fuse resistor, a temperature fuse is broken through heat generated from one resistive element disposed at one side of the temperature fuse and thus, an excessive amount of heat is generated in a normal state in which rated current or rated voltage is applied. On the other hand, in the fuse resistor 100 in accordance with the present invention, the first and second resistive elements 130 and 135 divide voltage or current and may thus disperse heat.

Figure 6:
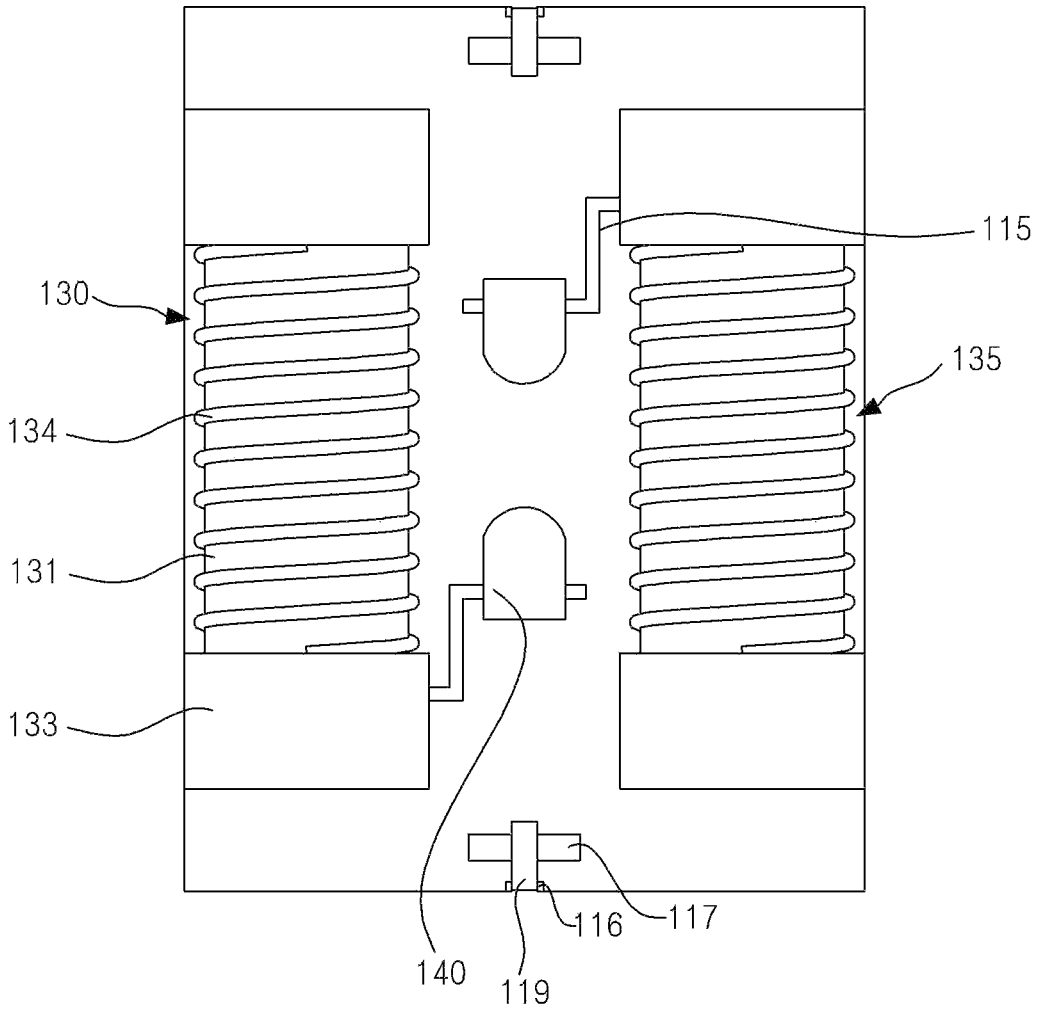
FIG. 6 is a plan view illustrating breaking of the temperature fuse in accordance with the present invention by heat generated from the first and second resistive elements.

Next, with reference to FIG. 6, in the fuse resistor 100 in accordance with the present invention, for example, when overcurrent of 1 A is continuously applied for a designated time if rated current is 300 mA, the first and second resistive elements 130 and 135 disposed at both sides of the temperature fuse 140 generate heat and transfer the heat to the temperature fuse 140, thus being capable of shortening breaking time of the temperature fuse 140.

Further, in the fuse resistor 100 in accordance with the present invention, if inrush current generated when power is supplied is applied, such current is restricted to current of less than a designated value by the first and second resistive elements 130 and 135, thus protecting the electrical circuit.

Figure 7:
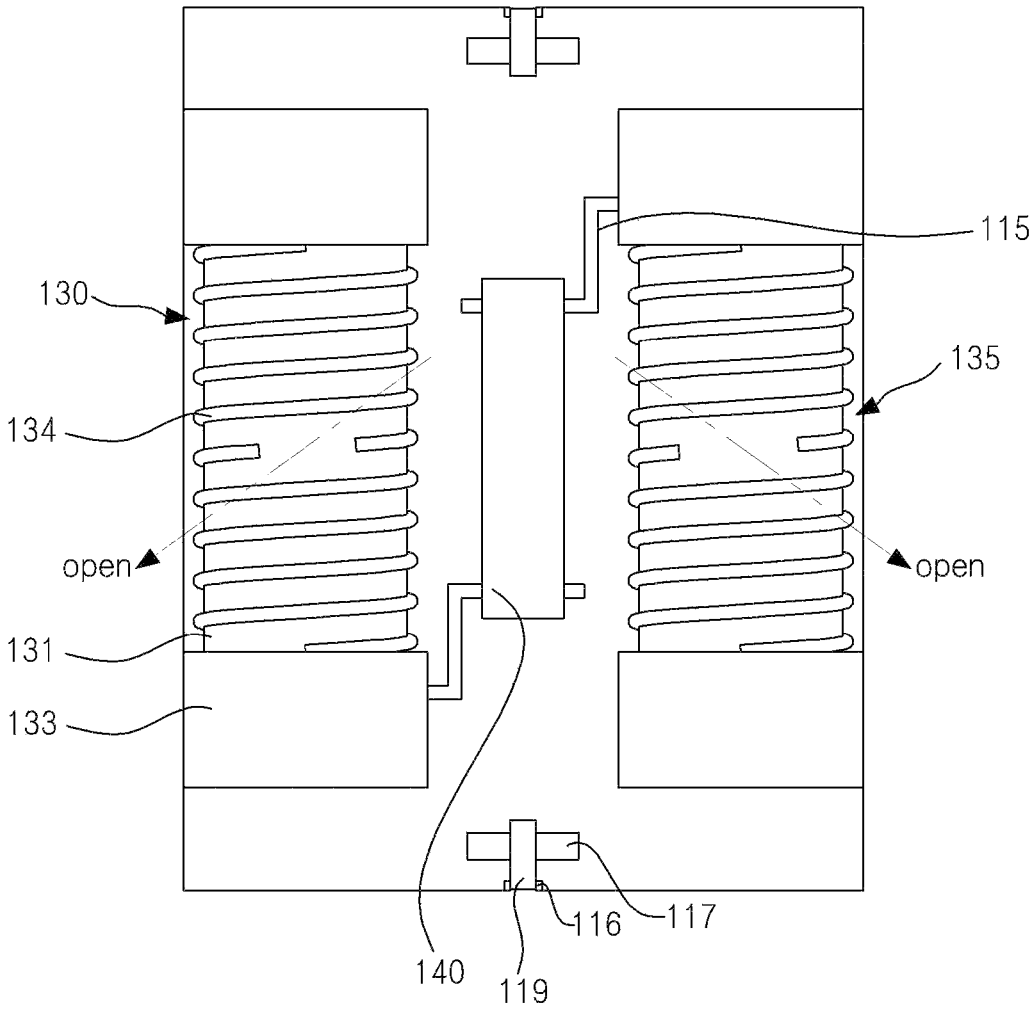
FIG. 7 is a plan view illustrating shorts of coils of the first and second resistive elements in accordance with the present invention by surge voltage or abnormal operation of an electrical circuit.

Further, with reference to FIG. 7, the first and second resistive elements 130 and 135 are designed so as to withstand predetermined voltage, for example, surge voltage of 6 kV or less, without explosion and, if surge voltage exceeding 6 kV is applied, the coils 134 of the resistive elements 130 and 135 are opened and thus the electrical circuit is protected.

Further, the fuse resistor 100 in accordance with the present invention may protect the electrical circuit even if the electrical circuit or the elements mounted on the electrical circuit are abnormally operated. For example, if a short occurs in the electrical circuit or if the element mounted on the electrical circuit is damaged and aged, the coil 134 of the first resistive element 130 or the coil 134*a* of the second resistive element 135 is opened and thus protects the electrical circuit.

Figure 8:
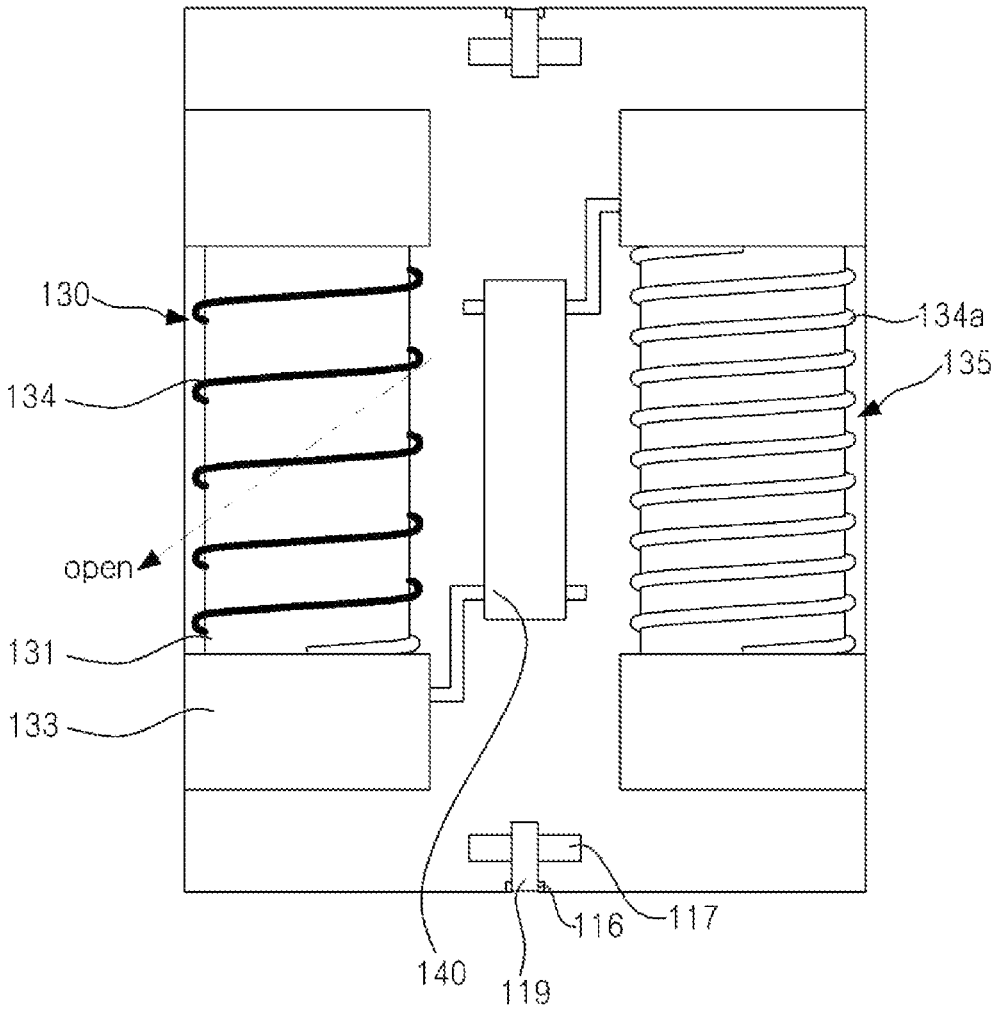
FIG. 8 is a plan view illustrating the first and second resistive elements in accordance with the present invention having different coil diameters and different coil turn numbers.

With reference to FIG. 8, coils 134 and 134*a* of the first and second elements 130 and 135 in accordance with the present invention may have different diameters and different turn numbers.

For example, the coil 134 of the first resistive element 130 may have a smaller diameter, a smaller turn number and a smaller resistance value, and the coil 134*a* of the second resistive element 135 may have a larger diameter, a larger turn number and a larger resistance value, as compared to the first resistive element 130.

Figure 9A:
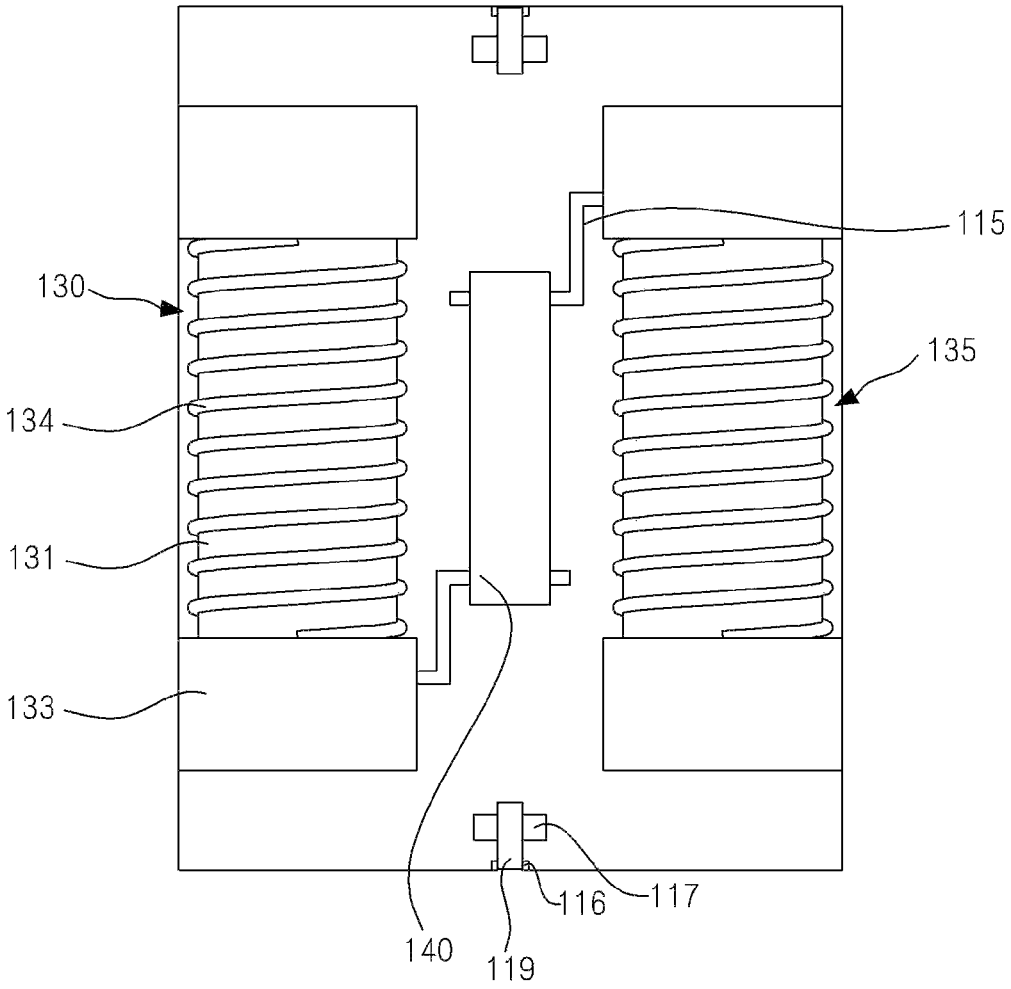
FIGS. 9A to 9E are plan views illustrating different arrangements of resistive elements and a temperature fuse on the substrate in accordance with the present invention.
Figure 9B:
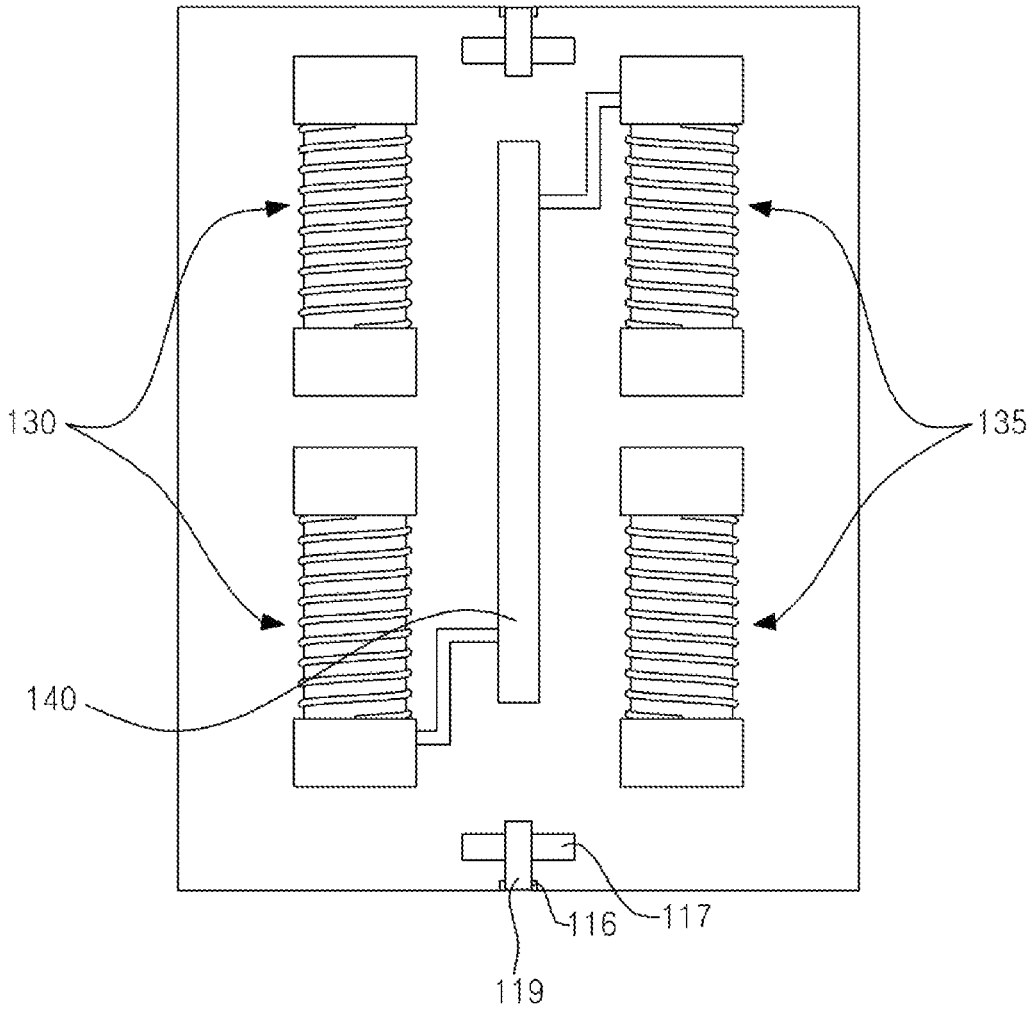
Figure 9C:
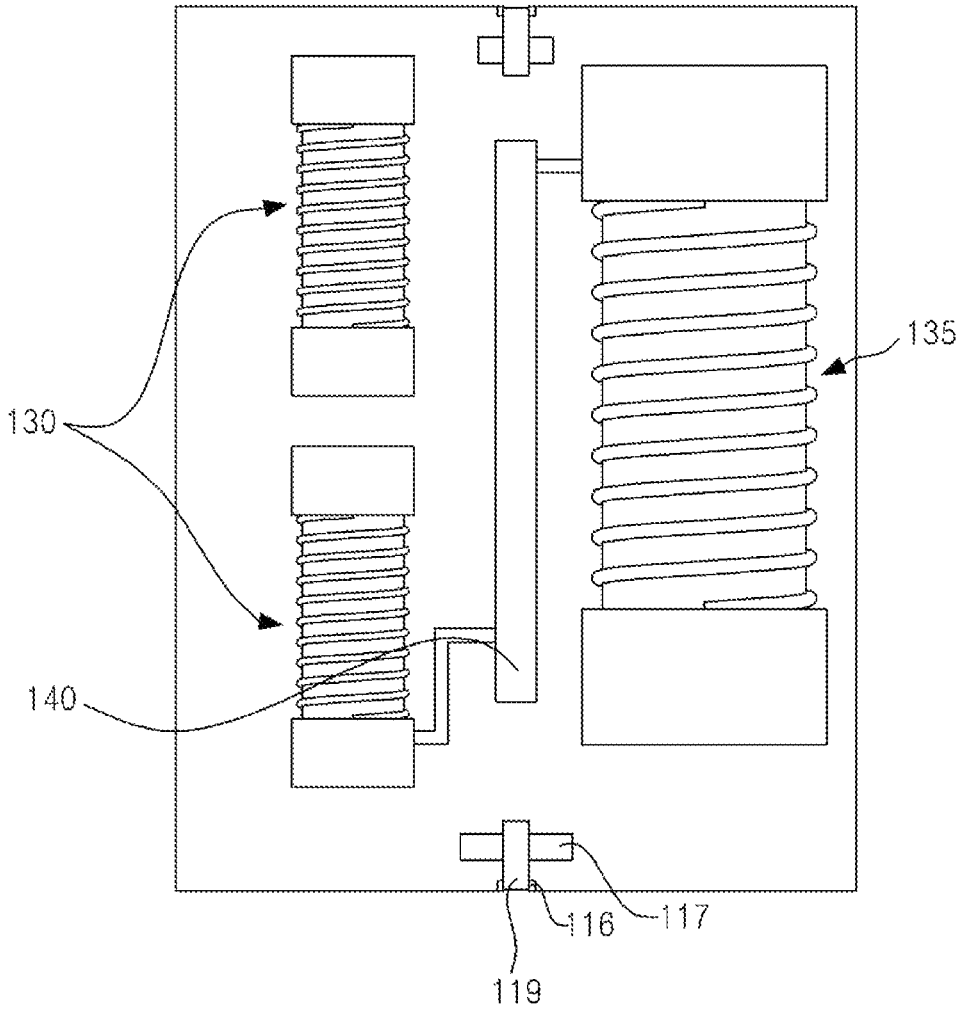
Figure 9D:
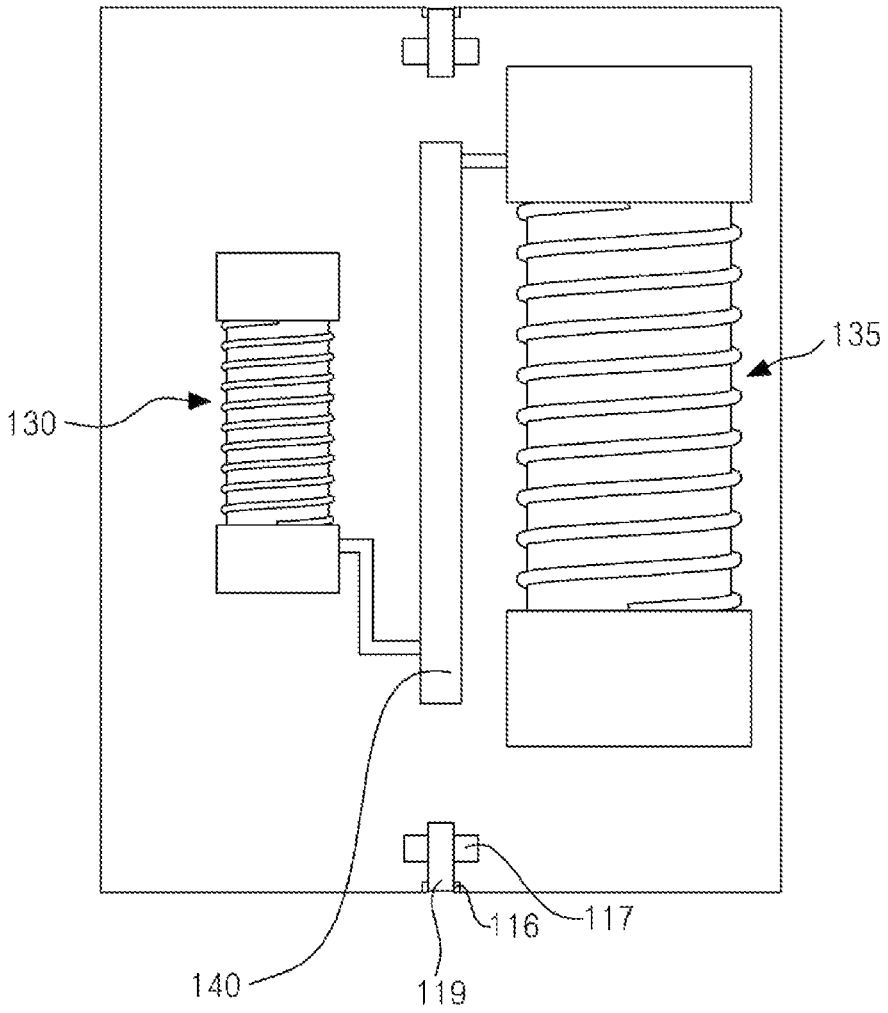
Figure 9E:
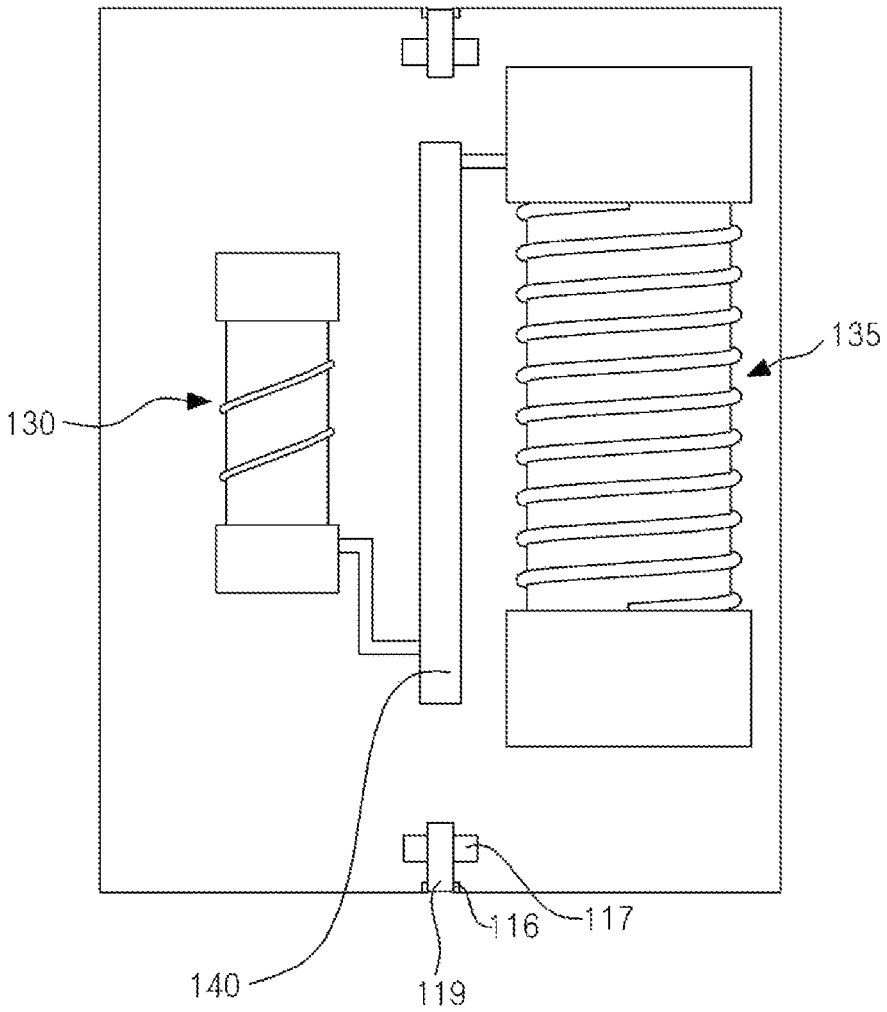
Figure 10:
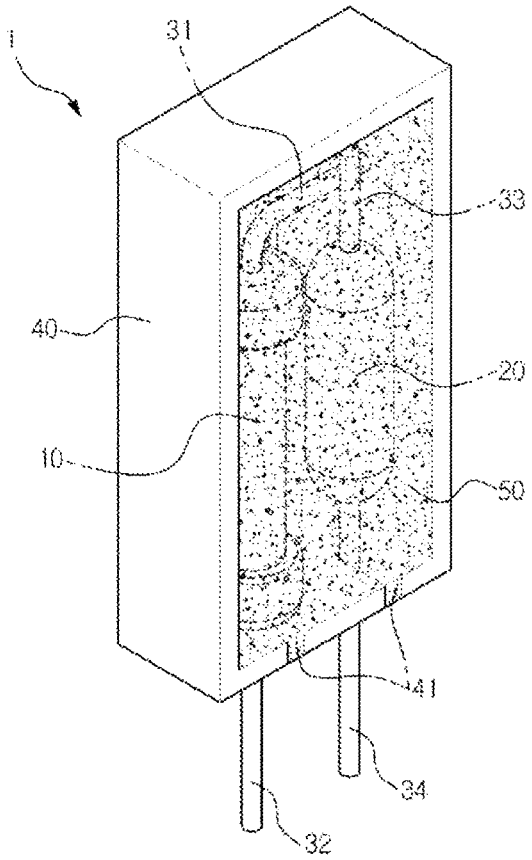
FIG. 10 PRIOR ART
FIG. 10 is a perspective view of a temperature fuse resistor according to conventional art.

With reference to FIG. 9E, a resistive body of the first resistive element 130 may be smaller than a resistive body of the second resistive element 134, and a coil of the first resistive element 130 may have a smaller turn number than a coil of the second resistive element 134.

As such, if the first and second resistive elements 130 and 135 are configured such that the coil of the first resistive element 130 has a smaller diameter and a smaller turn number than the coil of the second resistive element 134 (with reference to FIG. 8) or if the first and second resistive elements 130 and 135 are configured such that the resistive body of the first resistive element 130 is smaller than the resistive body of the second resistive element 134 and the coil of the first resistive element 130 has a smaller turn number than the coil of the second resistive element 134 (with reference to FIG. 9E), ③ if surge voltage exceeding a designated voltage value is applied and ④ if the electrical circuit and the elements are abnormally operated, the coil of the first resistive element 130 is opened and thus, the electrical circuit and the elements are protected.

For example, if the electrical circuit and the elements are abnormally operated, the coil of the first resistive element having relatively small diameter, small turn number and small resistance value is opened and thus, the fuse resistor 100 in the present invention may greatly reduce noise and impact, as compared to the conventional fuse resistor including one resistive element.

With reference to FIGS. 9A to 9E, the first and second resistive element 130 and 135 may be provided plural or singular in number.

For example, one first resistive element 130 and one second resistive element 135 may be disposed at both sides of the temperature fuse 140, as exemplarily shown in FIG. 9A, or plural first resistive elements 130 and plural second resistive elements 135 may be disposed at both sides of the temperature fuse 140, as exemplarily shown in FIG. 9B.

Further, first resistive elements 130 and second resistive elements 135 may not be provided in the same number but may be provided in different numbers according to conditions, as exemplarily shown in FIG. 9C.

Otherwise, a first resistive element 130 and a second resistive element 135 may not have the same size and the same resistance value but may have different sizes and different resistance values, as exemplarily shown in FIGS. 9D and 9E.

Consequently, in the fuse resistor in accordance with the present invention, for example, when overcurrent of 1 A is applied for a designated time if rated current is 300 mA, the first and second resistive elements disposed at both sides of the temperature fuse generate heat and rapidly break the temperature fuse, thus protecting the corresponding circuit.

Further, in the fuse resistor in accordance with the present invention, if inrush current is applied, such current is restricted to designated current by the resistive elements, and if surge voltage is applied or the electrical circuit is abnormally operated, the coils of the resistive elements are opened and thus the circuit is protected.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A fuse resistor provided on an electrical circuit to protect the electrical circuit and elements, the fuse resistor comprising:

a substrate on which first and second resistive terminals and fuse terminals are formed;

first and second resistive elements surface-mounted on the first and second resistive terminals and dividing applied voltage; and a temperature fuse surface-mounted on the fuse terminals to be broken by heat generated from the first and second resistive elements, wherein, the first and second resistive elements are installed at both sides of the temperature fuse, if overcurrent or overvoltage is applied, the first and second resistive elements generate heat and the temperature fuse is broken by the generated heat, and wherein the temperature fuse is physically located substantially between and substantially parallel with the first and second resistive elements, and wherein the first resistive element is not identical with the second resistive element, such that the first resistive element and the second resistive element do not fail simultaneously.

2. The fuse resistor according to claim 1, wherein each of the first and second resistive elements is a wound type resistive element including a resistive body, resistive caps provided at both ends of the resistive body, and a coil wound on the outer circumferential surface of the resistive body.

3. The fuse resistor according to claim 2, wherein the first and second resistive elements have the same resistance value and the coils of the first and second resistive elements have the same diameter.

4. The fuse resistor according to claim 2, wherein the first and second resistive elements have different resistance values and the coils of the first and second resistive elements have different diameters.

5. The fuse resistor according to claim 2, wherein:

the resistive body of the first resistive element is smaller than the resistive body of the second resistive element;

the coil of the first resistive element has a smaller turn number than the coil of the second resistive element; and if the electrical circuit or the elements mounted on the electrical circuit are abnormally operated, at least the coil of the first resistive element is opened.

6. The fuse resistor according to claim 5, wherein:

the first resistive element has a smaller resistance value than the second resistive element and the coil of the first resistive element has a smaller diameter than the coil of the second resistive element; and if the electrical circuit or the elements mounted on the electrical circuit are abnormally operated, at least the coil of the first resistive element is opened.

7. The fuse resistor according to claim 5, wherein, if a short occurs in the electrical circuit or if the elements mounted on the electrical circuit are damaged and aged, at least the coil of the first resistive element is opened.

8. The fuse resistor according to claim 6, wherein, if a short occurs in the electrical circuit or if the elements mounted on the electrical circuit are damaged and aged, at least the coil of the first resistive element is opened.

9. The fuse resistor according to claim 1, wherein:

lead wire terminals are formed on the substrate; and surface mount type lead wires are mounted on the lead wire terminals.

10. The fuse resistor according to claim 1, wherein the substrate is provided with a pad which is combined with a main substrate using solder ball.

11. A fuse resistor provided on an electrical circuit to protect the electrical circuit and elements, the fuse resistor comprising:

a substrate on which first and second resistive terminals and fuse terminals are formed;

first and second resistive elements surface-mounted on the first and second resistive terminals and dividing applied voltage; and a temperature fuse surface-mounted on the fuse terminals to be broken by heat generated from the first and second resistive elements, and wherein the first resistive element is not identical with the second resistive element, such that the first resistive element and the second resistive element do not fail simultaneously.

12. The fuse resistor of claim 11, wherein the first resistive element has a different resistance than the second resistive element.

13. The fuse resistor of claim 11, wherein the first resistive element has a different coil diameter than the second resistive element.

14. The fuse resistor of claim 11, wherein the first resistive element has a different turn number than the second resistive element.

* * * * *